US010219966B2

(12) United States Patent
Benfield et al.

(10) Patent No.: US 10,219,966 B2
(45) Date of Patent: Mar. 5, 2019

(54) HEADREST ADJUSTMENT SYSTEM

(71) Applicant: Kavo Dental Technologies, LLC, Charlotte, NC (US)

(72) Inventors: Thomas Mark Benfield, York, SC (US); Lindsey Michael Howe, Belmont, NC (US)

(73) Assignee: KAVO DENTAL TECHNOLOGIES, LLC, Charlotte, NC (US)

( * ) Notice: Subject to any disclaimer, the term of this patent is extended or adjusted under 35 U.S.C. 154(b) by 129 days.

(21) Appl. No.: 15/374,340

(22) Filed: Dec. 9, 2016

(65) Prior Publication Data

US 2018/0161227 A1 Jun. 14, 2018

(51) Int. Cl.
*A61G 15/12* (2006.01)
*A61G 15/02* (2006.01)

(52) U.S. Cl.
CPC ..... *A61G 15/125* (2013.01); *A61G 15/02* (2013.01)

(58) Field of Classification Search
CPC ..... A61G 15/02; A61G 15/125; A47C 1/06; A47C 3/28; A47C 7/38; A47C 7/402; B60N 2/818
See application file for complete search history.

(56) References Cited

U.S. PATENT DOCUMENTS 1,509,542 A * 9/1924 Case ..... A61G 15/02 248/397
1,527,754 A * 2/1925 Simon ..... A61G 5/1059 297/284.1
2,172,063 A * 9/1939 Hara ..... A61G 15/02 248/596
2,282,109 A * 5/1942 Angell ..... A47C 1/143 297/19
2,985,228 A * 5/1961 Golden ..... A47C 1/06 297/409
3,467,352 A * 9/1969 Bohler ..... A47C 3/28 248/125.1
3,563,603 A * 2/1971 D'Aprile ..... B60N 2/818 297/410
3,578,384 A * 5/1971 Leichtl ..... B60N 2/826 297/410
3,698,765 A * 10/1972 Olsen ..... A47C 7/38 297/396
3,885,831 A * 5/1975 Rasmussen ..... A47C 7/38 297/405
4,111,484 A * 9/1978 Jaeger ..... A47C 7/38 248/414

(Continued)

*Primary Examiner* — James M Ference
(74) *Attorney, Agent, or Firm* — Michael Best & Friedrich LLP

(57) ABSTRACT

A headrest adjustment system includes a tension block having a threaded aperture extending entirely through the tension block. The tension block is configured to be coupled to a chair. The headrest adjustment system also includes a screw configured to be moved through the threaded aperture along an axis, and a clamp lever pivotally coupled to the tension block. The clamp lever has an inclined surface. The axis intersects the inclined surface at an oblique angle. The headrest adjustment system also includes a headrest tension bracket configured to be coupled to the chair. The headrest tension bracket has a first end and a second end and the second end includes a flange. The clamp lever is configured to contact and press against the flange upon movement of the screw.

21 Claims, 5 Drawing Sheets

(56) References Cited

U.S. PATENT DOCUMENTS

| | | | | | |
|---|---|---|---|---|---|
| 4,128,274 | A * | 12/1978 | Schmedemann | A47C 7/38 | 108/146 |
| 4,335,920 | A * | 6/1982 | Hirth | A61G 15/125 | 297/391 |
| 5,177,823 | A * | 1/1993 | Riach | A47C 7/38 | 297/408 |
| 5,267,778 | A * | 12/1993 | Krebs | A61G 15/02 | 297/316 |
| 5,690,387 | A * | 11/1997 | Sarti | A47C 7/383 | 297/397 |
| 6,616,236 | B1 * | 9/2003 | Su | A47C 7/38 | 248/118 |
| 7,690,729 | B2 * | 4/2010 | Liao | A47C 7/38 | 297/408 |
| 7,770,977 | B2 * | 8/2010 | Diller | A61G 15/125 | 297/284.9 |
| 2004/0046435 | A1 * | 3/2004 | Bonn | A47C 7/38 | 297/409 |
| 2006/0250001 | A1 * | 11/2006 | Becker | B60N 2/888 | 297/216.12 |
| 2008/0018159 | A1 * | 1/2008 | Grunow | A47C 7/38 | 297/402 |
| 2013/0093232 | A1 * | 4/2013 | Lin | A47C 7/38 | 297/397 |

* cited by examiner

HEADREST ADJUSTMENT SYSTEM

BACKGROUND

Embodiments relate to headrest adjustment systems, particularly for dental chairs.

Dental chairs typically include a headrest. The headrest supports a patient's head while the patient is seated or otherwise resting in the chair.

SUMMARY

To ensure patient comfort, headrests should be easily adjustable. It is often desirable that a headrest be easily slid up or down with one hand to adjust it for different patients. It is also desirable that a headrest be lockable in place (or otherwise maintain its position) once a desired adjustment is achieved. Maintaining a particular position after adjustment is important to securely support the patient's head during dental procedures.

Many current adjustment mechanisms utilize either a threaded adjustment screw acting directly on a friction block against the headrest glide bar or a rotating cam driven by an adjustable screw to apply pressure to a friction block or clamping bracket. However, these mechanisms are not always satisfactory.

One embodiment provides a headrest adjustment system including a tension block having a threaded aperture extending entirely through the tension block. The tension block is configured to be coupled to a chair. The headrest adjustment system also includes a screw configured to be moved through the threaded aperture along an axis, and a clamp lever pivotally coupled to the tension block. The clamp lever has an inclined surface. The axis intersects the inclined surface at an oblique angle. The headrest adjustment system also includes a headrest tension bracket configured to be coupled to the chair. The headrest tension bracket has a first end and a second end and the second end includes a flange. The clamp lever is configured to contact and press against the flange upon movement of the screw.

Another embodiment provides a chair having a headrest, an elongate headrest slide bar or similar element coupled to and extending from the headrest, a backrest, and a guide element coupled to the backrest. The guide element defines a housing that receives and guides the headrest slide element. The chair also includes a headrest tension bracket coupled to the guide element. The headrest tension bracket has a first end and a second end pivotable about the first end. The second end includes a flange. The chair also includes a tension block coupled to the backrest. The tension block has a threaded aperture extending entirely through the tension block along an axis. The chair also includes a screw configured to be moved through the threaded aperture along the axis, and a clamp lever pivotally coupled to the tension block. The flange extends between the tension block and the backrest. An end of the screw is configured to contact and press against a surface of the clamp lever.

Among other benefits, this and other embodiments provide for adjustment of headrest slide bar tension with a nearly infinite range of adjustment via the tension bracket. Once set, the tension bracket maintains a tension setting until mechanical wear of the components occurs. At such time, a slight adjustment may be made to maintain a desired amount of drag.

Other embodiments and aspects will become apparent by consideration of the detailed description and accompanying drawings.

DETAILED DESCRIPTION

Before any embodiments are explained in detail, it is to be understood that the invention is not limited in its application to the details of construction and the arrangement of components set forth in the following description or illustrated in the following drawings. The invention is capable of other embodiments and of being practiced or of being carried out in various ways. In addition, a device or structure disclosed as being configured in a certain way can be configured in at least that way, but can also be configured in ways that are not listed. In addition, in the following description, it can be seen that various features are grouped together in various embodiments for the purpose of streamlining the disclosure. This does not mean that the claimed embodiments require more features than are expressly recited in each claim. It only means that inventive subject matter may be encompassed in fewer than all features of a single disclosed embodiment or combinations (whether full or partial) of disclosed embodiments as set forth in the written description.

Figure 1:
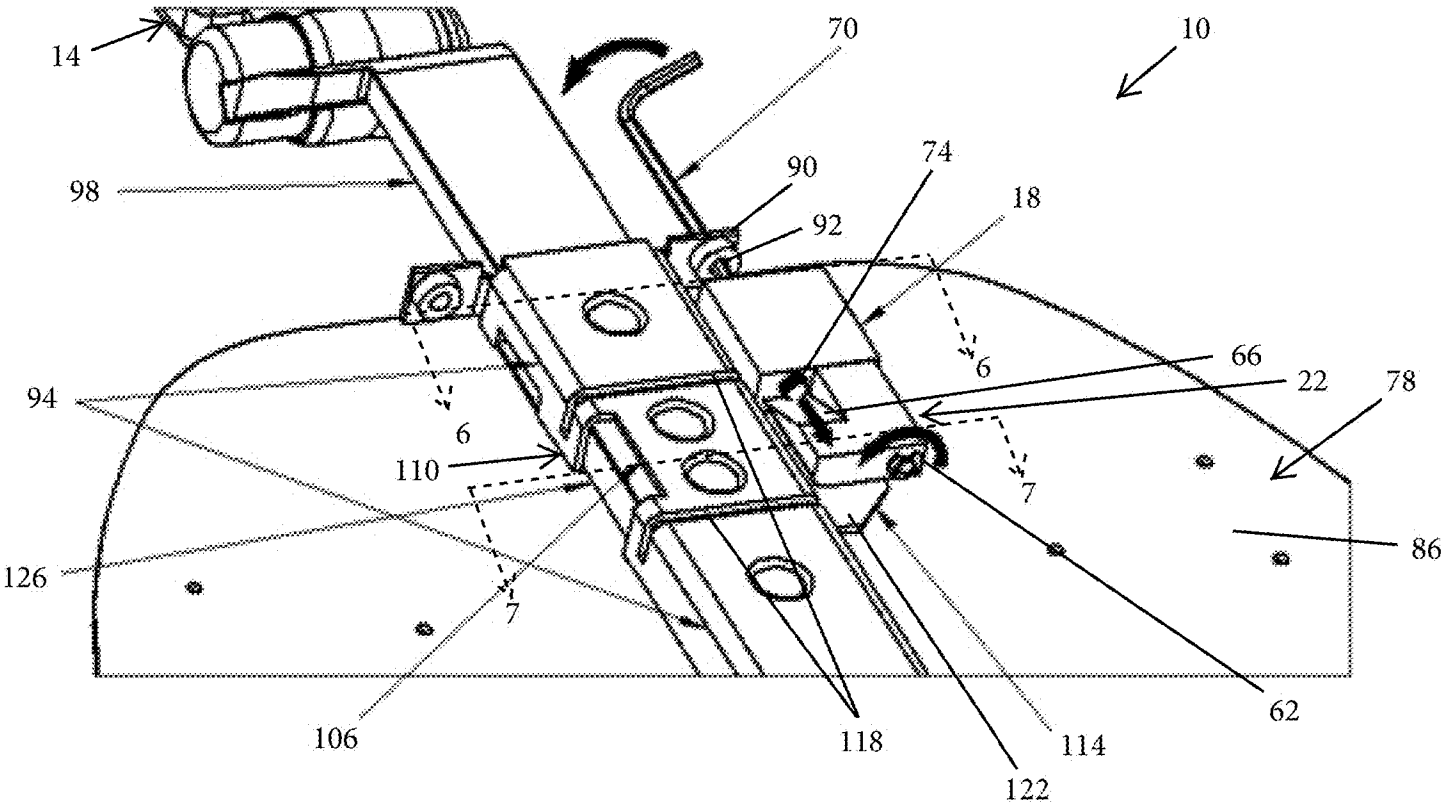
FIG. 1 is a rear, perspective view of a dental chair and a headrest adjustment system for the dental chair.
Figure 2:
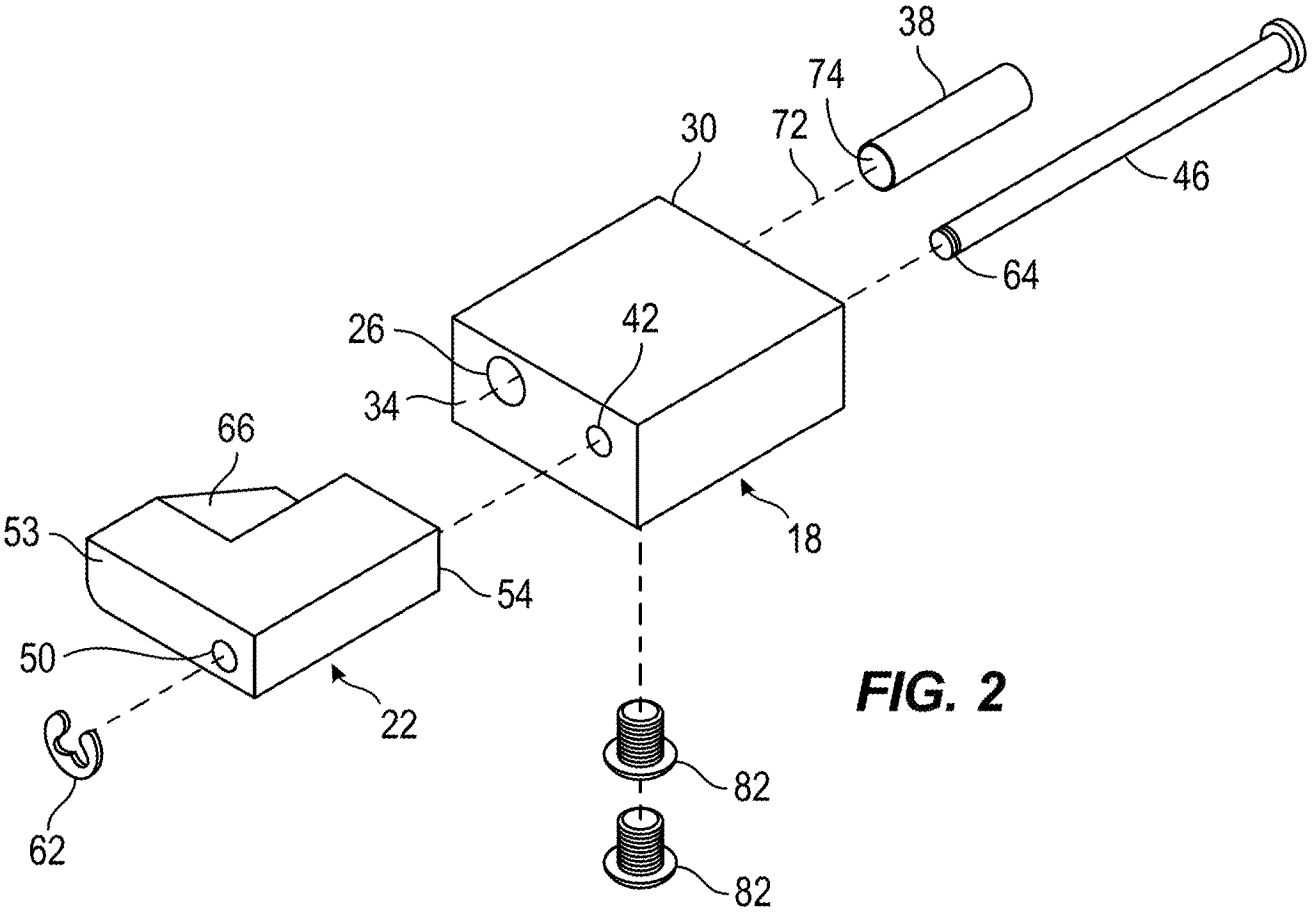
FIG. 2 is an exploded, perspective view of a tension block and clamp lever of the headrest adjustment system.
Figure 4:
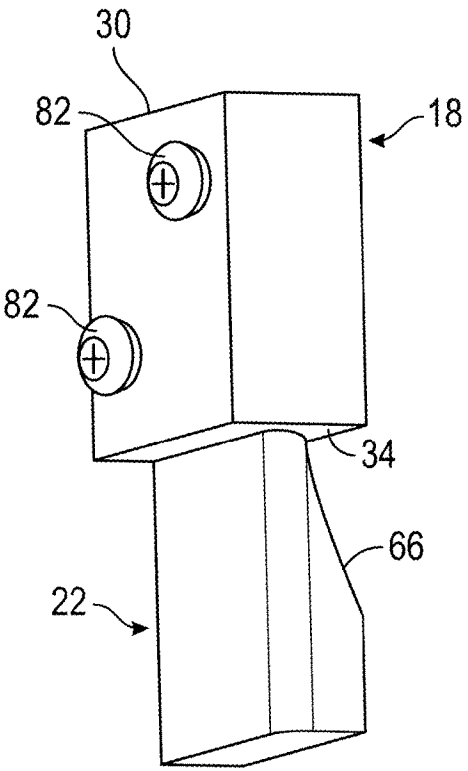
FIGS. 3 and 4 are perspective views of the tension block and clamp lever assembled together.
Figure 3:
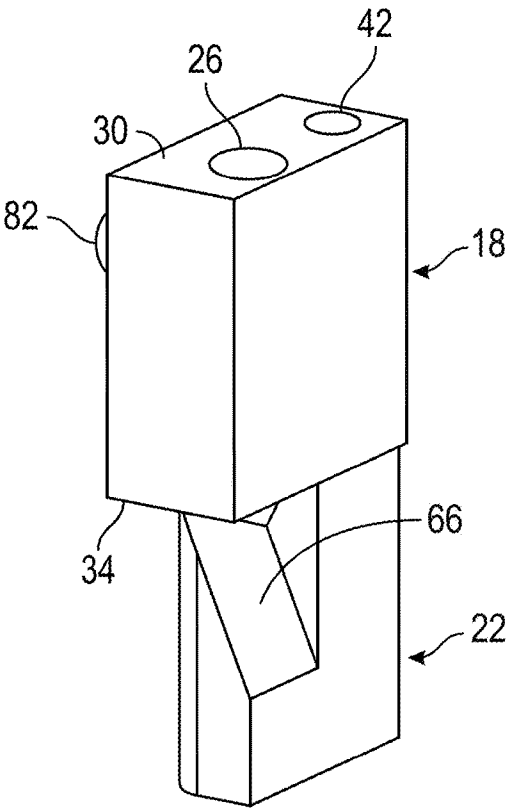

FIGS. 1-4 illustrate a headrest adjustment system 10 that adjusts a position of a headrest 14 (FIG. 1). The headrest adjustment system 10 includes a tension block 18, and a clamp lever 22 coupled to the tension block 18. As illustrated in FIGS. 2 and 3, the tension block 18 includes a first aperture 26 that extends entirely through the tension block 18 from a first end 30 of the tension block 18 to a second, opposite end 34 of the tension block 18.

The headrest adjustment system 10 also includes a screw 38. In the illustrated construction, the first aperture 26 is a threaded aperture sized and shaped to receive the screw 38. The illustrated screw 38 is a set screw, although other constructions include different sizes and types of screws 38 than that illustrated.

With continued reference to FIGS. 2 and 3, the tension block 18 also includes a second aperture 42 that extends entirely through the tension block 18 from the first end 30 to the second end 34. The headrest adjustment system 10 also includes a pivot pin 46. In the illustrated construction, the second aperture 42 is sized and shaped to receive the pivot pin 46.

With reference to FIG. 2, the clamp lever 22 includes an aperture 50 that extends entirely through the clamp lever 22 from a first end 54 of the clamp lever 22 to a second end 58 of the clamp lever 22. In the illustrated construction, the aperture 50 is sized and shaped to receive the pivot pin 46. The pivot pin 46 has a length such that when the tension block 18 and the clamp lever 22 are coupled together, a portion of the pivot pin 46 is within the tension block 18, and another portion of the pivot pin 46 is within the clamp lever 22. As illustrated in FIG. 2, a retaining element 62 (e.g., a retaining ring) may be used to retain the pivot pin 46 within both the tension block 18 and the clamp lever 22, and prevent withdrawal therefrom. For example, in the illustrated construction the pivot pin 46 includes a groove 64 that is shaped and sized to receive the retaining element 62. Once assembled, the tension block 18 and the clamp lever 22 are pivotally coupled to one another about the pivot pin 46. Other constructions include different pivoting structures and arrangements for the tension block 18 and the clamp lever 22. For example, in some constructions a living hinge or other structure is provided to pivotably couple the clamp lever 22 to the tension block 18.

With reference to FIGS. 1-4, the clamp lever 22 includes an inclined surface 66 that is contacted and pressed by the screw 38. For example, as illustrated in FIG. 1, when the screw 38 is turned with a tool 70 (e.g., an Allen wrench), the screw 38 translates linearly within the tension block 18 along an axis 72 (FIG. 2) until an end 74 of the screw 38 protrudes from the tension block 18 and contacts and presses against the inclined surface 66. The axis 72 intersects the inclined surface 66 at an oblique angle. When the end 74 of the screw 38 contacts and presses against the inclined surface 66, the clamp lever 22 is forced to rotate about the pivot pin 46 (e.g., counterclockwise as illustrated by the arrow in FIG. 1).

With reference to FIG. 1, the tension block 18 itself is coupled (e.g., fixed) to a chair 78. In the illustrated construction, the chair 78 is a dental chair, although other constructions include different types, sizes, and shapes of chairs. With reference to FIGS. 2 and 3, in the illustrated construction the headrest adjustment system 10 includes two fasteners 82 that couple the tension block 18 directly to a backrest 86 of the chair 78, such that the tension block 18 is fixed relative to the chair 78, and the clamp lever 22 remains pivotable relative to the tension block 18.

With continued reference to FIG. 1, in the illustrated construction the chair 78 also includes a bracket 90 coupled to the backrest 86 that positions and guides the tool 70. The tool 70 extends through an opening 92 in the bracket 90, so as to engage the screw 38. In some constructions the tool 70 is removably coupled to the bracket 90 (e.g., slides in and out), such that when the headrest adjustment system 10 is not in use (e.g., when the headrest 14 does not need adjustment), the tool 70 may be removed entirely from the chair 78.

Figure 6:
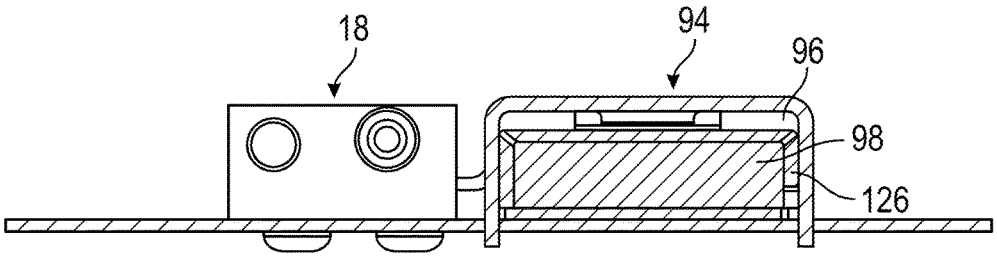
FIGS. 6 and 7 are cross-sectional views of the headrest adjustment system, taken along lines 6-6 and 7-7, respectively, in FIG. 1.

With continued reference to FIG. 1, the headrest adjustment system 10 further includes a guide element 94 that is sized and shaped to receive and guide a headrest slide element 98. In the illustrated construction the headrest slide element 98 is an elongate bar having a generally rectangular cross-section that is coupled directly to and extends below the headrest 14. The guide element 94 is a housing that is coupled to (e.g., fixed) the backrest 86 of the chair 78. The guide element 94 includes an aperture 96 (FIGS. 6 and 7) that is sized and shaped to receive the headrest slide element 98. For example, in some constructions the aperture is rectangular. The guide element 94 guides the headrest slide element 98 (and consequently the headrest 14) between different positions along the backrest 86 (e.g., different heights for different dental patients). Other constructions include different shapes and sizes for the guide element 94 and the headrest slide element 98 than that illustrated. For example, in some constructions the headrest slide element 98 has a square, oval, or circular cross-sectional shape. In some constructions more than one headrest slide element 98 and/or guide element 94 is provided.

Figure 7:
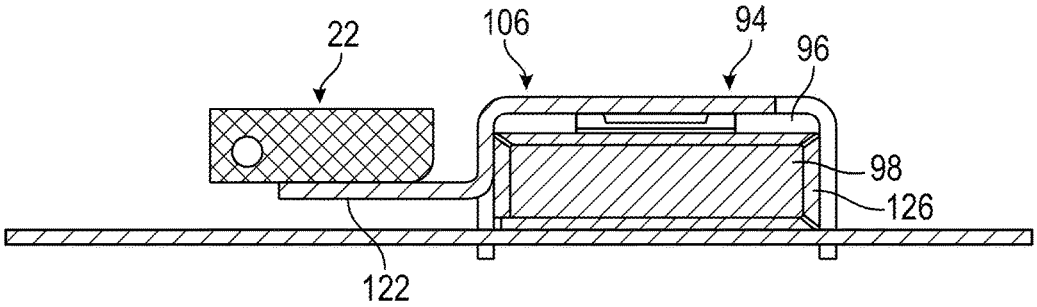

With continued reference to FIG. 1, the headrest adjustment system 10 further includes a headrest tension bracket 106. In the illustrated construction, the headrest tension bracket 106 is integrally formed as a single piece with the guide element 94, although in other constructions the headrest tension bracket 106 is a separate piece. The headrest tension bracket 106 includes a first end 110 and a second, opposite end 114. The headrest tension bracket 106 is formed in part by two slits 118 in the guide element 94, thereby creating a living hinge that pivots at the first end 110 and includes a flange 122 defined by the second end 114 that is positioned underneath the clamp lever 22 (FIG. 7).

Figure 5:
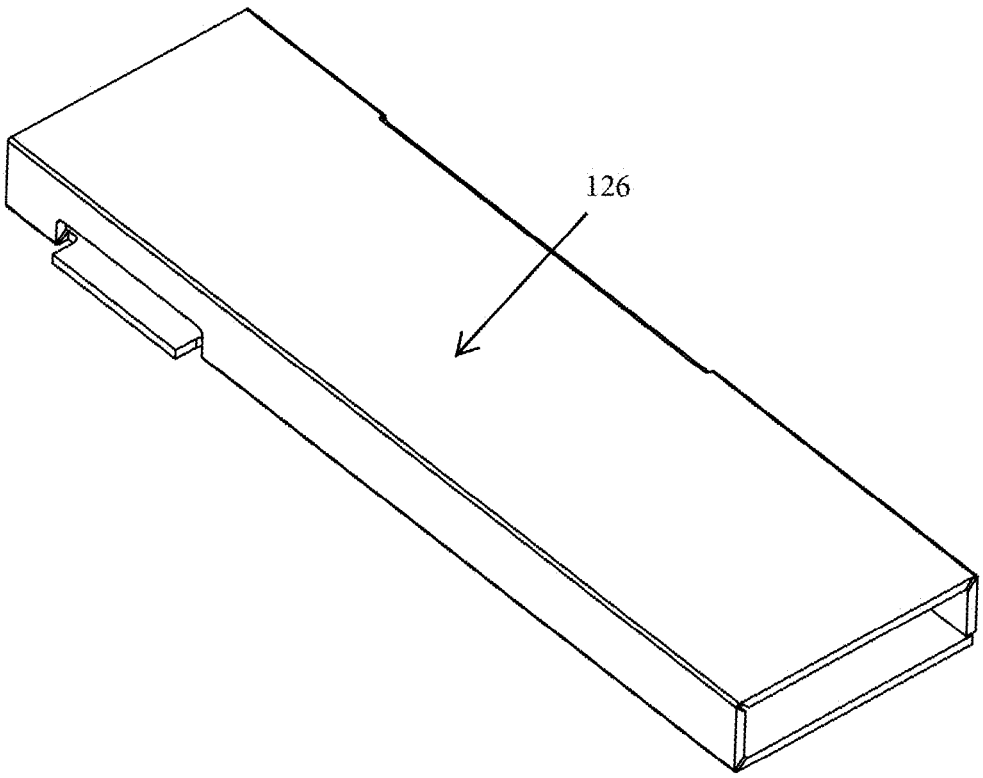
FIG. 5 is a perspective view of a sleeve of the headrest adjustment system.

With continued reference to FIG. 1, in the illustrated construction the headrest adjustment system 10 also includes a sleeve 126. The sleeve 126 is positioned at least partially under the headrest tension bracket 106, although in other constructions the sleeve 126 is formed integrally as a single piece with the headrest tension bracket 106 or with the guide element 94. The sleeve 126 is sized and shaped to receive and directly contact the headrest slide element 98. For example, in some constructions the sleeve 126 includes an aperture, groove, or other structure that receives at least a portion of the headrest slide element 98. In the illustrated construction the sleeve 126 is made of plastic, although other constructions include different materials. In some constructions the sleeve 126 is not provided, and the headrest tension bracket 106 itself directly receives and contacts the headrest slide element 98. FIG. 5 illustrates one construction of the sleeve 126.

With continued reference to FIG. 1, to fix a position of the headrest 14, the headrest slide element 98 is first moved within the guide element 94 until the headrest 14 is at a desired position. The tool 70 is then inserted through the bracket 90. In some constructions a screw or other structure (not shown) is threaded or inserted into the bracket 90 during times of non-adjustment, to block insertion of the tool 70. In such constructions the screw or other structure is first removed, prior to insertion of the tool 70. With the tool 70 inserted through the bracket 90, the tool 70 is then pushed into engagement with the screw 38. The screw 38 is then rotated with the tool 70, causing the screw 38 to move linearly along the axis 72 until the end 74 of the screw 38 contacts and presses against the inclined surface 66. As the screw 38 continues to rotate, the screw 38 continues to press against the inclined surface 66, forcing the clamp lever 22 to pivot about the pivot pin 46, and to press against the flange 122 of the headrest tension bracket 106. This pressing action forces the headrest tension bracket 106 to pivot about the first end 110, and to press toward the backrest 86 and toward the sleeve 126, thereby forcing the sleeve 126 to frictionally engage and securely hold the headrest slide element 98 (and the headrest 14) in place. In constructions without the sleeve 126, the headrest tension bracket 106 itself presses directly against the headrest slide element 98, frictionally engaging and holding the headrest slide element 98 (and the headrest 14) in place. The amount of frictional engagement and securement may be altered by applying more or less force (e.g., torque) with the tool 70.

To make further adjustments for a different patient, the tool 70 is inserted through the bracket 90. The screw 38 is then rotated in an opposite direction, causing the screw 38 to pull away from the inclined surface 66 along the axis 72, thereby allowing the flange 122 to move away from the backrest 86, and thereby loosening the frictional contact and engagement of the headrest slide element 98. The headrest slide element 98 may then be adjusted (e.g., moved up or down relative to the backrest 86) until the headrest 14 is at an exact, desired position. The headrest adjustment system 10 may then be used again to fix the position of the headrest 14.

Variations and modifications exist within the scope and spirit of one or more independent aspects of the embodiments described.

Various embodiments, features, and advantages are set forth in the following claims.

What is claimed is:

1. A headrest adjustment system comprising:

a tension block having a threaded aperture extending entirely through the tension block, the tension block configured to be coupled to a chair;

a screw configured to be rotated and moved through the threaded aperture along a first axis;

a clamp lever pivotably coupled to the tension block about a second axis that is parallel to the first axis, the clamp lever having an inclined surface, wherein the first axis intersects the inclined surface at an oblique angle; and a headrest tension bracket configured to be coupled to the chair, the headrest tension bracket having a first end and a second end, the second end including a flange, wherein the clamp lever is configured to be rotated about the second axis and to contact and press against the flange upon rotation of the screw in a tightening direction along the first axis.

2. The headrest adjustment system of claim 1, wherein the threaded aperture is a first aperture, wherein the tension block includes a second aperture extending entirely through the tension block, and wherein the headrest adjustment system further includes a pivot pin that extends through the second aperture.

3. The headrest adjustment system of claim 2, wherein the clamp lever includes an aperture, wherein the pivot pin extends through both the second aperture of the tension block and the aperture of the clamp lever.

4. The headrest adjustment system of claim 3, further comprising a retaining ring coupled to the pivot pin to prevent withdrawal of the pivot pin from the tension block and the clamp lever.

5. The headrest adjustment system of claim 1, further comprising a fastener that extends into the tension block to prevent movement of the screw along the first axis.

6. The headrest adjustment system of claim 1, further comprising a guide element defining a housing that is configured to be coupled to the chair and is sized and shaped to receive and guide an elongate headrest slide element.

7. The headrest adjustment system of claim 6, wherein the headrest tension bracket is integrally formed as a single piece with the guide element.

8. The headrest adjustment system of claim 7, wherein the headrest tension bracket is formed by two slits in the guide element.

9. The headrest adjustment system of claim 1, further comprising a sleeve disposed at least partially under the headrest tension bracket, wherein when the clamp lever contacts and presses against the flange, the headrest tension bracket is configured to press against the sleeve.

10. A chair comprising:

a headrest;

an elongate headrest slide element coupled to and extending from the headrest;

a backrest;

a guide element coupled to the backrest, the guide element defining a housing that receives and guides the headrest slide element;

a headrest tension bracket coupled to the guide element, the headrest tension bracket having a first end and a second end pivotable about the first end, the second end including a flange;

a tension block coupled to the backrest, the tension block having a threaded aperture extending entirely through the tension block;

a screw configured to be moved through the threaded aperture along an axis; and a clamp lever pivotally coupled to the tension block, wherein the flange extends between the tension block and the backrest, and wherein an end of the screw is configured to contact and press against a surface of the clamp lever.

11. The chair of claim 10, wherein the elongate headrest slide element has a rectangular cross-section.

12. The chair of claim 10, wherein the headrest tension bracket is integrally formed as a single piece with the guide element, and is formed by two slits in the guide element.

13. The chair of claim 10, wherein the threaded aperture is a first aperture, wherein the tension block includes a second aperture extending entirely through the tension block, and wherein a pivot pin extends through the second aperture.

14. The chair of claim 13, wherein the clamp lever includes an aperture, wherein the pivot pin extends through both the second aperture of the tension block and the aperture of the clamp lever.

15. The chair of claim 14, further comprising a retaining ring coupled to the pivot pin to prevent withdrawal of the pivot pin from the tension block and the clamp lever.

16. The chair of claim 10, further comprising a fastener that extends into the tension block to prevent movement of the screw along the axis.

17. The chair of claim 10, further comprising a sleeve disposed within the guide element, wherein when the clamp lever contacts and presses against the flange, the headrest tension bracket is configured to press against the sleeve and the sleeve is configured to press against the headrest slide element, thereby frictionally holding a position of the headrest.

18. The chair of claim 10, wherein the surface of the clamp lever is an inclined surface, and wherein the axis extends at an oblique angle relative to the inclined surface.

19. The chair of claim 10, further comprising a bracket coupled to the backrest, and a tool configured to engage the screw, wherein the tool is configured to be inserted through the bracket.

20. The chair of claim 19, wherein the screw is a set screw.

21. A headrest adjustment system comprising:

a tension block having a threaded aperture extending entirely through the tension block, the tension block configured to be coupled to a chair;

a screw configured to be moved through the threaded aperture along an axis;

a clamp lever pivotably coupled to the tension block, the clamp lever having an inclined surface, wherein the axis intersects the inclined surface at an oblique angle; and a headrest tension bracket configured to be coupled to the chair, the headrest tension bracket having a first end and a second end, the second end including a flange, wherein the clamp lever is configured to contact and press against the flange upon rotation of the screw in a tightening direction along the axis;

wherein the threaded aperture is a first aperture, wherein the tension block includes a second aperture extending entirely through the tension block, wherein the headrest adjustment system further includes a pivot pin that extends through the second aperture, wherein the clamp lever includes an aperture, and wherein the pivot pin extends through both the second aperture of the tension block and the aperture of the clamp lever.

* * * * *